US006263968B1

(12) United States Patent
Freeman et al.

(10) Patent No.: US 6,263,968 B1
(45) **Date of Patent: *Jul. 24, 2001**

(54) APPARATUS AND METHODS FOR COMPLETING A WELLBORE

(75) Inventors: Tommie Austin Freeman, Flower Mound; Thomas P. Wilson, Houston, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/483,980

(22) Filed: Jan. 18, 2000

Related U.S. Application Data

(63) Continuation of application No. 09/028,623, filed on Feb. 24, 1998.

(51) Int. Cl.[7] ..... E21B 43/30

(52) U.S. Cl. ..... 166/313; 166/50; 166/207

(58) Field of Search ..... 166/50, 52, 191, 166/207, 277, 313

(56) References Cited

U.S. PATENT DOCUMENTS

| | | | | |
|---|---|---|---|---|
| 2,397,070 | | 3/1946 | Zublin | 166/4 |
| 2,452,920 | | 11/1948 | Gilbert . | |
| 2,796,134 | * | 6/1957 | Binkley | 166/207 |
| 2,797,893 | | 7/1957 | McCune et al. . | |
| 2,812,025 | * | 11/1957 | Teague et al. | 166/207 |
| 2,858,107 | | 10/1958 | Colmerauer . | |
| 3,111,991 | * | 11/1963 | O'Neal | 166/207 |
| 3,393,744 | | 7/1968 | Qagg . | |
| 3,412,565 | * | 11/1968 | Lindsey et al. | 166/207 |
| 3,419,080 | * | 12/1968 | Lebourg | 166/207 |
| 3,489,220 | * | 1/1970 | Kinley | 166/207 |
| 4,396,075 | | 8/1983 | Wood et al. | 175/79 |
| 4,402,551 | | 9/1983 | Wood et al. | 299/5 |
| 4,415,205 | | 11/1983 | Rehm et al. | 299/5 |
| 4,444,276 | | 4/1984 | Peterson, Jr. | 175/61 |
| 4,569,396 | | 2/1986 | Brisco . | |
| 4,573,541 | | 3/1986 | Josse et al. | 175/78 |
| 4,718,496 | | 1/1988 | Tompkins . | |
| 4,807,704 | | 2/1989 | Hsu et al. | 166/313 |
| 5,083,608 | * | 1/1992 | Abdrakhmanov et al. | 166/207 |
| 5,318,122 | | 6/1994 | Murray et al. | 166/313 |
| 5,353,876 | | 10/1994 | Currington et al. | 166/313 |
| 5,361,836 | | 11/1994 | Serem . | |
| 5,388,648 | | 2/1995 | Jordan, Jr. | 166/380 |
| 5,501,281 | | 3/1996 | White et al. | 166/387 |
| 5,520,252 | | 5/1996 | McNair | 166/313 |
| 5,549,165 | | 8/1996 | Brooks . | |
| 5,564,503 | | 10/1996 | Longbottom et al. | 166/313 |

(List continued on next page.)

FOREIGN PATENT DOCUMENTS

| | | |
|---|---|---|
| 2 282 835 | 4/1995 | (GB) . |
| WO 97/30266 | 8/1997 | (WO) . |

OTHER PUBLICATIONS

Search Report for European Patent Application No. EP 99301350.

*Primary Examiner*—William Neuder
(74) *Attorney, Agent, or Firm*—William M. Imwalle, Esq.; Marlin R. Smith, Esq.

(57) ABSTRACT

Apparatus and methods for completing a wellbore are disclosed. Certain ones of the apparatus and methods use a first packing assembly, a second packing assembly, and a pressurization assembly disposed between the first and second packing assemblies to plastically deform a liner in a radially outward direction via hydraulic pressure. Another method uses a liner having a first section and a second section, and a packing assembly. The first section is deformable in a radially outward direction at a lower pressure than the second section. The packing assembly is used to plastically deform the first section of the liner in a radially outward direction via hydraulic pressure.

31 Claims, 9 Drawing Sheets

U.S. PATENT DOCUMENTS

| | | | | |
|---|---|---|---|---|
| 5,566,763 | | 10/1996 | Williamson et al. | 166/382 |
| 5,613,559 | | 3/1997 | Williamson et al. | 166/381 |
| 5,787,984 | * | 8/1998 | Mabile | 166/207 |
| 5,833,001 | * | 11/1998 | Song et al. | 166/207 |
| 5,884,704 | * | 3/1999 | Longbottom et al. | 166/313 |
| 5,964,288 | * | 10/1999 | Leighton et al. | 166/207 |
| 5,979,560 | * | 11/1999 | Nobileau | 166/207 |

* cited by examiner

APPARATUS AND METHODS FOR COMPLETING A WELLBORE

RELATED APPLICATIONS

This is a continuation, of application Ser. No. 09/028,623, filed Feb. 24, 1998, such prior application being incorporated by reference herein in its entirety.

This application is related to concurrently filed U.S. application Ser. No. 09/028,427, now abandoned, entitled "Apparatus and Methods for Completing a Wellbore", which is commonly assigned with the present invention and is incorporated herein by reference.

1. Field of the Invention

The present invention pertains to the completion of wellbores, and, more particularly, but not by way of limitation, to improved apparatus and methods for completing lateral wellbores in multilateral wells.

2. History of the Related Art

Horizontal well drilling and production have become increasingly important to the oil industry in recent years. While horizontal wells have been known for many years, only relatively recently have such wells been determined to be a cost-effective alternative to conventional vertical well drilling. Although drilling a horizontal well usually costs more than its vertical counterpart, a horizontal well frequently improves production by a factor of five, ten, or even twenty in naturally-fractured reservoirs. Generally, projected productivity from a horizontal wellbore must triple that of a vertical wellbore for horizontal drilling to be economical. This increased production minimizes the number of platforms, cutting investment, and operation costs. Horizontal drilling makes reservoirs in urban areas, permafrost zones, and deep offshore waters more accessible. Other applications for horizontal wellbores include periphery wells, thin reservoirs that would require too many vertical wellbores, and reservoirs with coning problems in which a horizontal wellbore lowers the drawdown per foot of reservoir exposed to slow down coning problems.

Some wellbores contain multiple wellbores extending laterally from the main wellbore. These additional lateral wellbores are sometimes referred to as drainholes, and main wellbores containing more than one lateral wellbore are referred to as multilateral wells. Multilateral wells allow an increase in the amount and rate of production by increasing the surface area of the wellbore in contact with the reservoir. Thus, multilateral wells are becoming increasingly important, both from the standpoint of new drilling operations and from the reworking of existing wellbores, including remedial and stimulation work.

As a result of the foregoing increased dependence on and importance of horizontal wells, horizontal well completion, and particularly multilateral well completion, have been important concerns and continue to provide a host of difficult problems to overcome. Lateral completion, particularly at the junction between the main and lateral wellbores, is extremely important to avoid collapse of the wellbore in unconsolidated or weakly consolidated formations. Thus, open hole completions are limited to competent rock formations; and, even then, open hole completions are inadequate since there is limited control or ability to access (or reenter the lateral) or to isolate production zones within the wellbore. Coupled with this need to complete lateral wellbores is the growing desire to maintain the lateral wellbore size as close as possible to the size of the primary vertical wellbore for ease of drilling, completion, and future workover.

The problem of lateral wellbore (and particularly multilateral wellbore) completion has been recognized for many years, as reflected in the patent literature. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 2,397,070 similarly describes lateral wellbore completion using flexible casing together with a closure shield for closing off the lateral. In U.S. Pat. No. 2,858,107, a removable whipstock assembly provides a means for locating (e.g. accessing) a lateral subsequent to completion thereof. U.S. Pat. Nos. 4,396,075; 4,415,205; 4,444,276; and 4,573,541 all relate generally to methods and devices for multilateral completions using a template or tube guide head. Other patents of general interest in the field of horizontal well completion include U.S. Pat. Nos. 2,452,920 and 4,402,551.

More recently, U.S. Pat. Nos. 5,318,122; 5,353,876; 5,388,648; and 5,520,252 have disclosed methods and apparatus for sealing the juncture between a vertical well and one or more horizontal wells. In addition, U.S. Pat. No. 5,564,503, which is commonly assigned with the present invention and is incorporated herein by reference, discloses several methods and systems for drilling and completing multilateral wells. Furthermore, U.S. Pat. Nos. 5,566,763 and 5,613,559, which are commonly assigned with the present invention and are incorporated herein by reference, both disclose decentralizing, centralizing, locating, and orienting apparatus and methods for multilateral well drilling and completion.

Notwithstanding the above-described efforts toward obtaining cost-effective and workable lateral well drilling and completions, a need still exists for improved apparatus and methods for completing lateral wellbores. Toward this end, there also remains a need to increase the economy in lateral wellbore completions, such as, for example, by minimizing the number of downhole trips necessary to drill and complete a lateral wellbore.

SUMMARY OF THE INVENTION

One aspect of the present invention comprises a completion apparatus for coupling to a work string and for use within a liner of a wellbore. The completion apparatus includes a first packing assembly for creating a fluid tight seal against a liner in a wellbore; a second packing assembly for creating a second fluid tight seal against the liner; and a pressurization assembly disposed between the first and second packing assemblies.

In another aspect, the present invention comprises a method of completing a wellbore. A liner is disposed in a wellbore. A first packing assembly, a pressurization assembly, and a second packing assembly are coupled to a work string. The work string is run into the liner. A fluid tight seal is created between the first packing assembly and the liner, and a fluid tight seal is created between the second packing assembly and the liner. Fluid is pumped down the work string to the pressurization assembly. The pressurization assembly and fluid are utilized to pressurize an annulus defined by the pressurization assembly, the liner, the first packing assembly, and the second packing assembly. The pressure in the annulus is increased so as to deform the liner in a radially outward direction.

In a further aspect, the present invention comprises a method of completing a wellbore. A liner is provided having a first section and a second section. The first section is deformable in a radially outward direction at a lower pressure than the second section. The liner is disposed in a wellbore. A packing assembly is coupled to a work string, and the work string is run into the liner. A fluid tight seal is created between the packing assembly and the liner. Fluid is pumped down the work string to pressurize an interior of the liner after the packing assembly. The pressure in the interior of the liner is increased so as to deform the first section of the liner in a radially outward direction.

BRIEF DESCRIPTION OF THE DRAWINGS

For a more complete understanding of the present invention and for further objects and advantages thereof, reference may now be had to the following description taken in conjunction with the accompanying drawings, in which.

DETAILED OF THE PREFERRED EMBODIMENTS

The preferred embodiments of the present invention and their advantages are best understood by referring to FIGS. 1–10 of the drawings, like numerals being used for like and corresponding parts of the various drawings. In accordance with the present invention, various apparatus and methods for completing lateral wellbores in a multilateral well are described. It will be appreciated that the terms "main" or "primary" as used herein refer to a main well or wellbore, whether the main well or wellbore is substantially vertical, substantially horizontal, or in between. It will also be appreciated that the term "lateral" as used herein refers to a deviation well or wellbore from the main well or wellbore, or another lateral well or wellbore, whether the deviation is substantially vertical, substantially horizontal, or in between. It will further be appreciated that the term "vertical" as used herein refers to a substantially vertical well or wellbore, and that the term "horizontal" as used herein refers to a substantially horizontal well or wellbore.

In the overall process of drilling and completing a lateral wellbore in a multilateral well, the following general steps are performed. First, the main wellbore is drilled, and the main wellbore casing is installed and cemented into place. Once the desired location for a junction is identified, a window is then created in the main wellbore casing using an orientation device, a multilateral packer, a hollow whipstock, and a series of mills. Next, the lateral wellbore is drilled, and a liner is disposed in the lateral wellbore and cemented into place. A mill is then used to drill through any cement plug at the top of the hollow whipstock and any portion of the lateral wellbore liner extending into the main wellbore to reestablish a fluid communicating bore through the main wellbore. Finally, in some lateral wellbores, a window bushing is disposed within the main wellbore casing, the hollow whipstock, and the multilateral packer. The window bushing facilitates the navigation of downhole tools through the junction between the main wellbore and the lateral wellbore.

Figure 1:
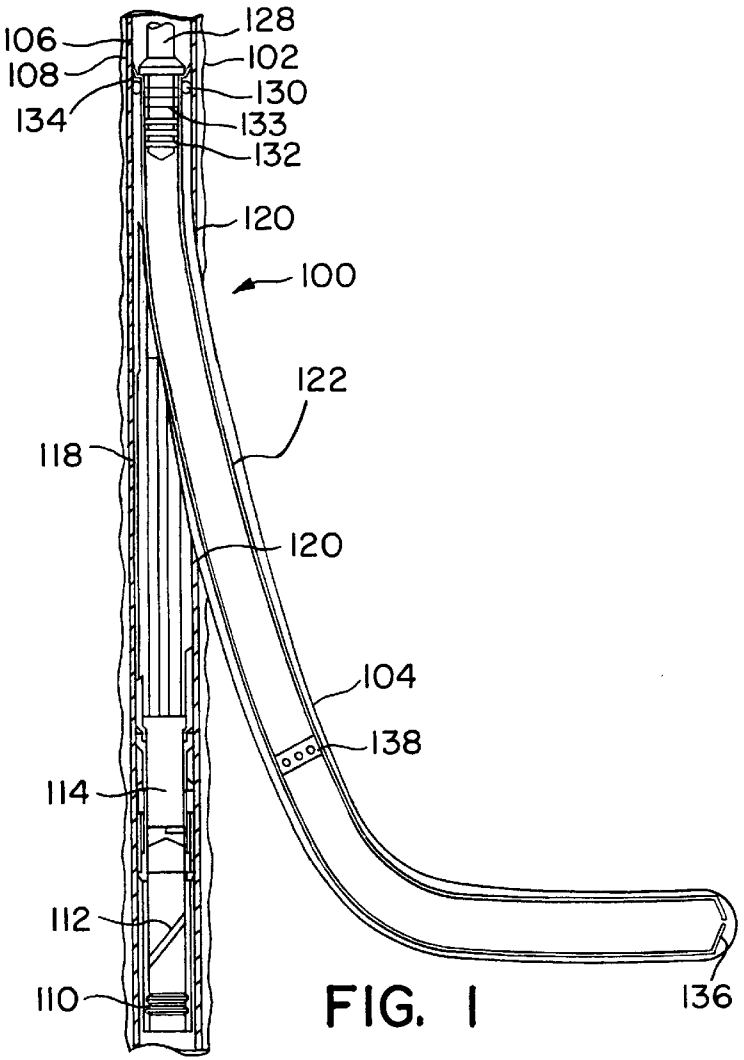
FIG. 1 is a schematic, cross-sectional view of a portion of a multilateral well including a junction between the main wellbore and a lateral wellbore.

The present invention is related to a portion of the above-described process, namely the completion of the junction between the main wellbore and a lateral wellbore. However, as described above, certain other steps are performed before such a junction may be completed. Referring now to FIG. 1, an exemplary junction 100 between a main wellbore 102 and a lateral wellbore 104 is illustrated. Main wellbore 102 is drilled using conventional techniques. A main wellbore casing 106 is installed in main wellbore 102, and cement 108 is disposed between main wellbore 102 and main wellbore casing 106, using conventional techniques.

A shearable work string having a window bushing locating profile 110, an orientation nipple 112, a multilateral packer assembly 114, a hollow whipstock 118, and a starter mill pilot lug (not shown) is run into main wellbore casing 106. Certain portions of such a work string are more fully disclosed in U.S. Pat. Nos. 5,613,559; 5,566,763; and 5,501,281, which are commonly assigned with the present invention and are incorporated herein by reference. The work string is located at the proper depth and orientation within main wellbore casing 106 using conventional pipe tally and/or gamma ray surveys for depth and measurement while drilling (MWD) orientation for azimuth. Packer assembly 114 is set against main wellbore casing 106 using slips, packing elements, and conventional hydraulic, mechanical, or hydraulic and mechanical setting techniques.

Using techniques more completely described in the above-referenced U.S. Pat. Nos. 5,613,559; 5,566,763; and 5,501,281, whipstock 118 is used to guide work strings supporting a variety of tools and equipment to drill and complete lateral well bore 104. First, a series of mills, such as a starter mill, a window mill, and a watermelon mill are used to create a window 120 in main wellbore casing 106. Next, a drilling motor is used to drill lateral wellbore 104 from window 120. A lateral wellbore liner 122 is then disposed within lateral wellbore 104, and sealant 124 is disposed between lateral wellbore 104 and liner 122.

More specifically regarding the steps of disposing and sealing liner 122, liner 122 preferably has a generally cylindrical axial bore and a generally cylindrical external surface. Liner 122 is preferably made from steel, steel alloys, plastic, or other materials conventionally used for lateral liners. A work string 128 having a liner hanger 130, wiper plugs 132 and 133, and liner 122 is run down main wellbore casing 106 until liner 122 is deflected by hollow whipstock 118. This deflection causes liner 122 to be disposed in lateral wellbore 104 and junction 100. Liner hanger 130 and wiper plugs 132 and 133 remain disposed above window 120. Liner hanger 130 is then set against main wellbore casing 106 using conventional techniques.

Figure 2:
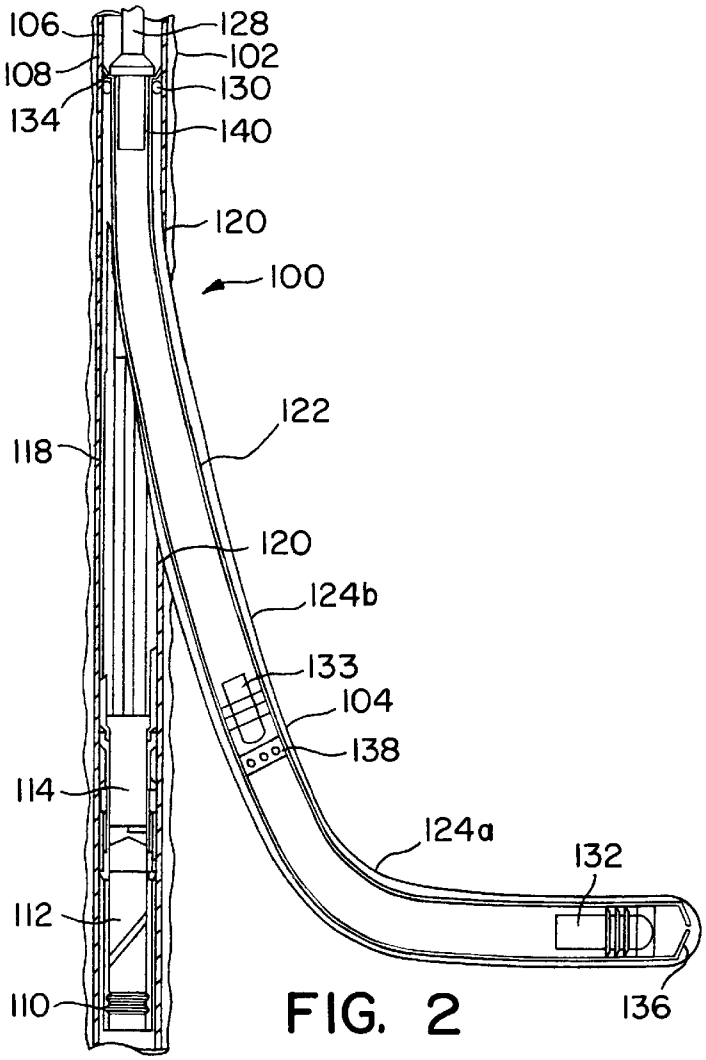
FIG. 2 is a schematic, cross-sectional view of FIG. 1 showing a portion of the sealing operation performed during completion of the lateral wellbore.

Referring to FIGS. 1 and 2, cementing of lateral wellbore 104 may be accomplished by either one or two-stage cementing depending on the length of wellbore 104. Typically, the length of lateral wellbore 104 is such that two stage cementing is preferred. In a two-stage cementing operation, liner 122 is equipped with a stage cementing tool 138. Stage cementing tool 138 is initially in a first position that allows fluid communication within liner 122 past tool 138, but does not allow fluid communication from liner 122 into the annulus between liner 122 and lateral wellbore 104. A first stage of cement 124*a* is pumped down drill string 128 and out a lower end 136 of liner 122. First stage of cement 124*a* is preferably a conventional cement or conventional hardenable resin. Next, a conventional wiper dart (not shown) is pumped down drill string 128 to land at wiper plugs 132 and 133. After landing, applied pressure releases wiper plug 132 and allows it to be pumped down to, and seal off, lower end 136 of liner 122. This displacement of wiper plug 132 causes first stage of cement 124*a* to flow throughout the annulus between liner 122 and lateral wellbore 104 up to stage cementing tool 138. An increase in pressure may be observed top hole by conventional pressure measuring devices upon the landing of wiper plug 132 in lower end 136.

Continued application of pressure moves stage cementing tool 138 to a second position that prevents fluid communication within liner 122 past stage cementing tool 138, but allows fluid communication from liner 122 into the annulus between liner 122 and lateral wellbore 104. A second stage of sealant 124*b* is then pumped down drill string 128 and into liner 122. Next, a second wiper dart (not shown) is pumped down drill string 128 to land at wiper plug 133. After landing, applied pressure releases wiper plug 133 and allows it to be pumped down to, and seal off, liner 122 at stage cementing tool 138. This displacement of wiper plug 133 causes second stage of sealant 124*b* to flow through stage cementing tool 138 and into the annulus between lateral wellbore 104, main wellbore casing 106, and liner 122 up to a top portion 134 of liner 122, positioning sealant 124*b* throughout junction 100. Once wiper plug 133 lands at stage cementing tool 138, continued application of pressure moves stage cementing tool 138 to a third position, preventing further circulation or backflow of sealant 124*b*.

Sealant 124*b* is preferably a specialized multilateral junction cementitious sealant, or a specialized multilateral junction elastomeric sealant. A preferred example of such a cementitious sealant is M-SEAL™ sold by Halliburton Energy Services of Carrollton, Texas. Such cementitious sealants are characterized by relatively low ductility and high compressive strength, as compared to such elastomeric sealants. A preferred example of such an elastomeric sealant is FLEX-CEM™ sold by Halliburton Energy Services of Carrollton, Tex. Such elastomeric sealants are characterized by relatively high ductility and low compressive strength, as compared to such cementitious sealants. Alternatively, conventional cement or a conventional hardenable resin may be used as second stage sealant 124*b*.

Figure 3:
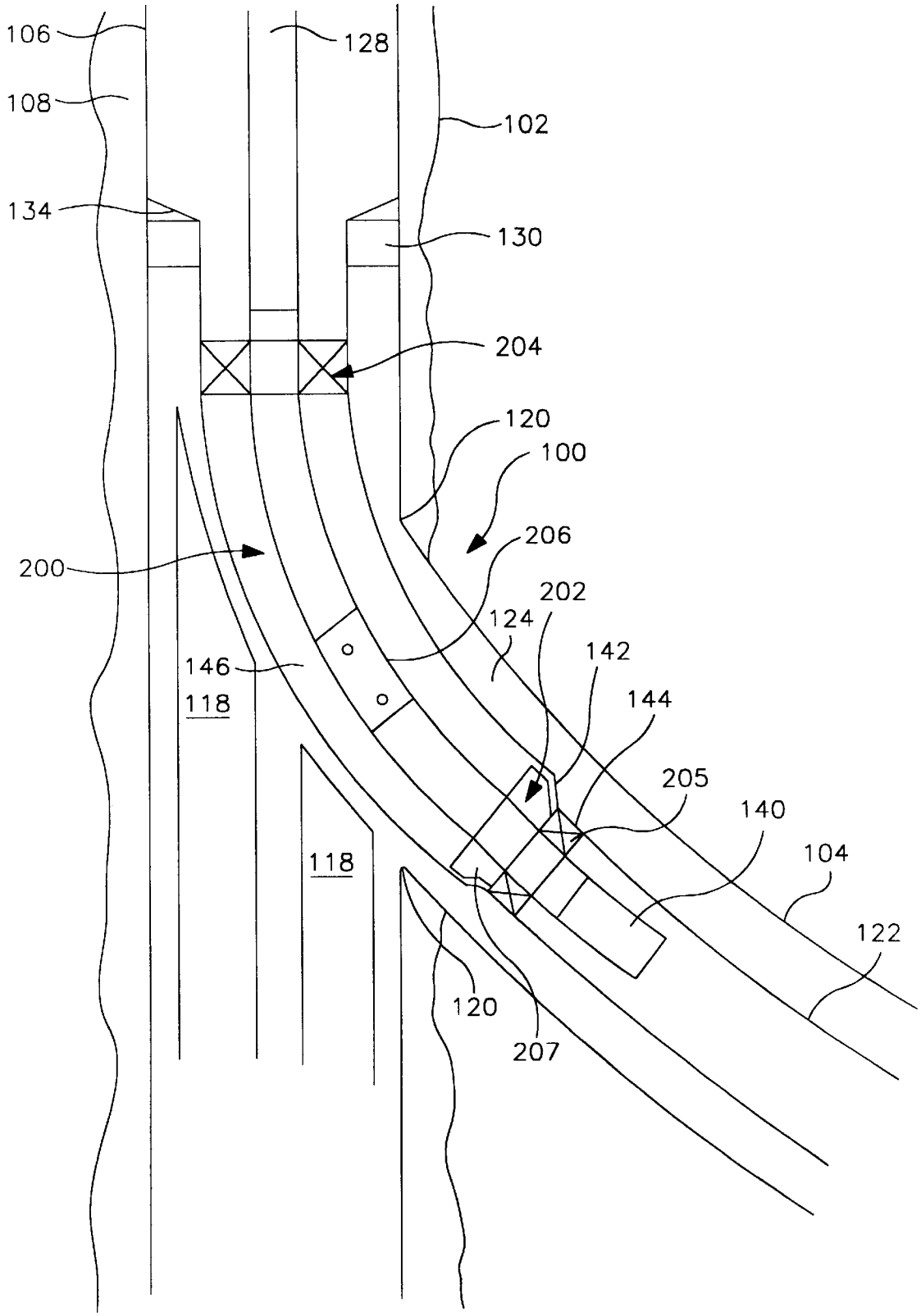
FIG. 3 is an enlarged, schematic, cross-sectional, fragmentary view of the junction of FIG. 1 showing a schematic view of apparatus for completing the junction according to a first, preferred embodiment of the present invention.

Referring now to FIG. 3, an enlarged, schematic, cross-sectional, view of a completion apparatus 200 according to a first, preferred embodiment of the present invention is shown disposed within junction 100. Completion apparatus 200 preferably comprises a hollow mandrel having a lower packing assembly 202, an upper packing assembly 204, and a pressurization assembly 206. Completion apparatus 200 is preferably coupled to work string 128 above a supporting mandrel 140 for wiper plugs 132 and 133, and lower packing assembly 202, upper packing assembly 204, and pressurization assembly 206 are preferably coupled to each other by tool joints or other conventional means (not shown). Although not shown in FIGS. 1 and 2 for clarity of illustration, liner 122 is preferably formed with a no-go shoulder 142 and an annular polished bore receptacle 144 below no-go shoulder 142.

Figure 4:
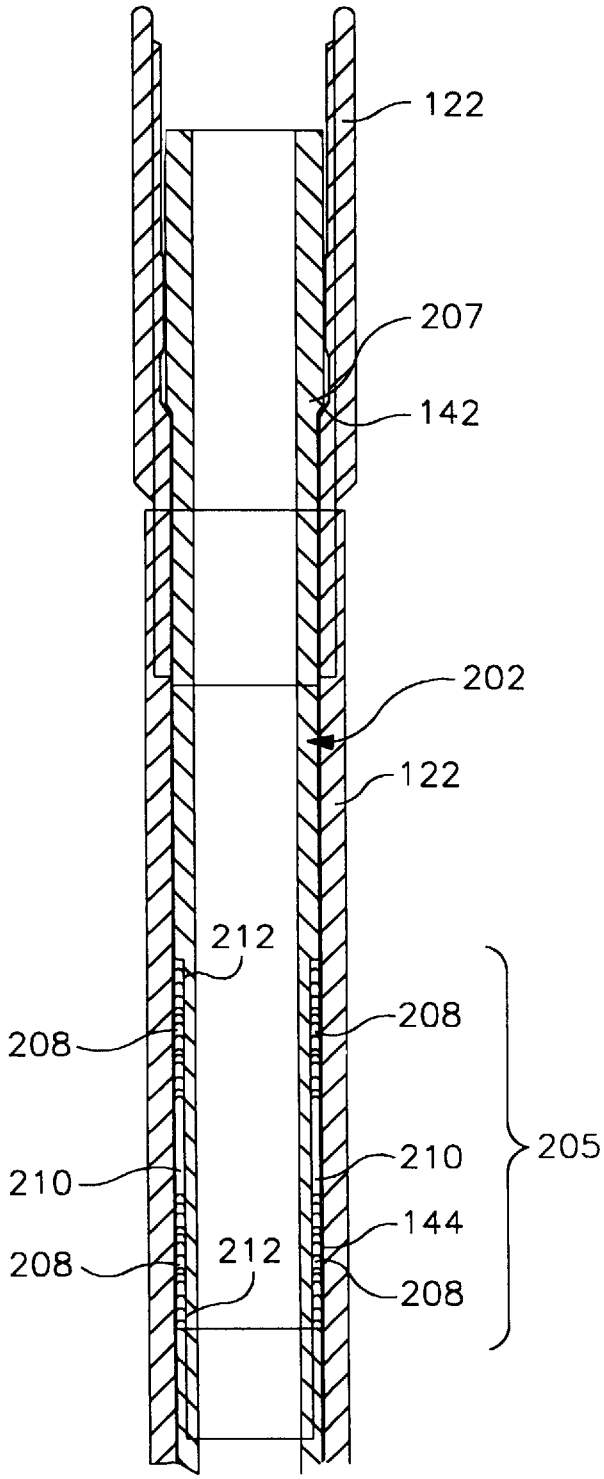
FIG. 4 is an enlarged, schematic, cross-sectional view of one embodiment of a packing assembly of the completion apparatus of FIG. 3.

As shown in FIGS. 3 and 4, lower packing assembly 202 preferably includes a seal assembly 205, and a no-go sleeve 207 for mating with no-go shoulder 142 of liner 122. Seal assembly 205 preferably comprises a plurality of annular sealing elements 208, such as conventional o-rings or packing devices, and an annular spacer member 210, both of which are disposed within an annular recess 212 on the external surface of lower packing assembly 202. Sealing elements 208 frictionally engage polished bore receptacle 144, which is located on the inner diameter of liner 122 and generally surrounds annular recess 212. Polished bore receptacle 144 cooperates with annular sealing elements 208 to create a fluid-tight seal.

Figure 5:
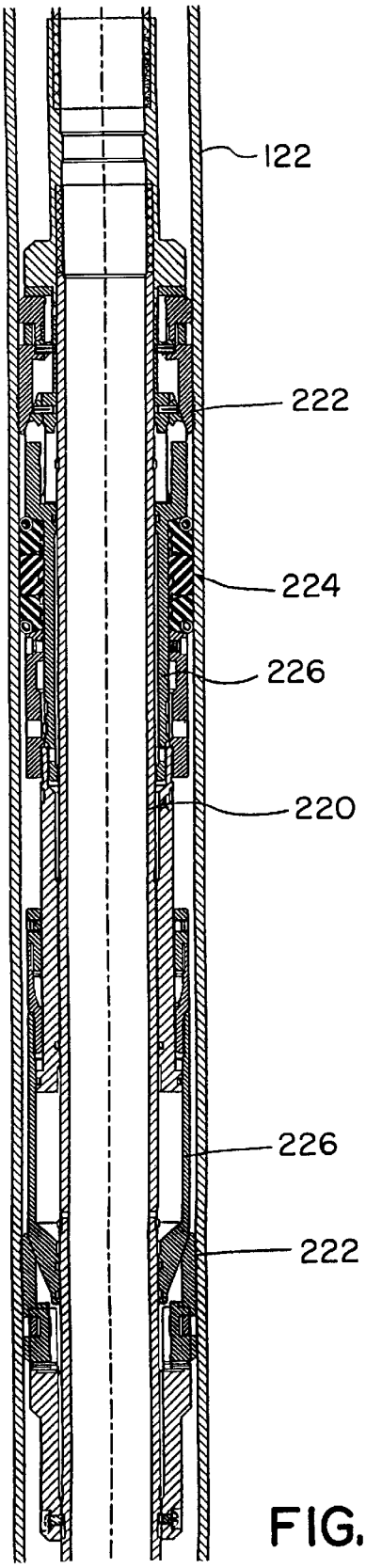
FIG. 5 is an enlarged, schematic, cross-sectional, view of a second embodiment of a packing assembly of the completion apparatus of FIG. 3.

Alternatively, as shown in FIGS. 3 and 5, lower packing assembly 202 may comprise a conventional packer 220 having slips 222, packing elements 224, and actuating means 226. Packer 220 may be hydraulically, mechanically, or hydraulically and mechanically set via actuating means 226 so that packing elements 224 create a fluid tight seal against liner 122. As shown in FIG. 5, when conventional packer 220 is used for lower packing assembly 202, liner 122 may be formed without no-go shoulder 142, if desired.

Upper packing assembly 204 preferably has a substantially similar structure to lower packing assembly 202. If seal assembly 205 is utilized for lower packing assembly 202, upper packing assembly 204 preferably utilizes a similar seal assembly that mates with a polished bore receptacle located on the inner diameter of liner 122 below liner hanger 130. If packer 220 is used for lower packing assembly 202, upper packing assembly 204 preferably utilizes a similar packer designed to operate within the inner diameter of liner 122 proximate liner hanger 130. However, as shown in FIG. 3, upper packing assembly 204 does not require a no-go sleeve.

Figure 6:
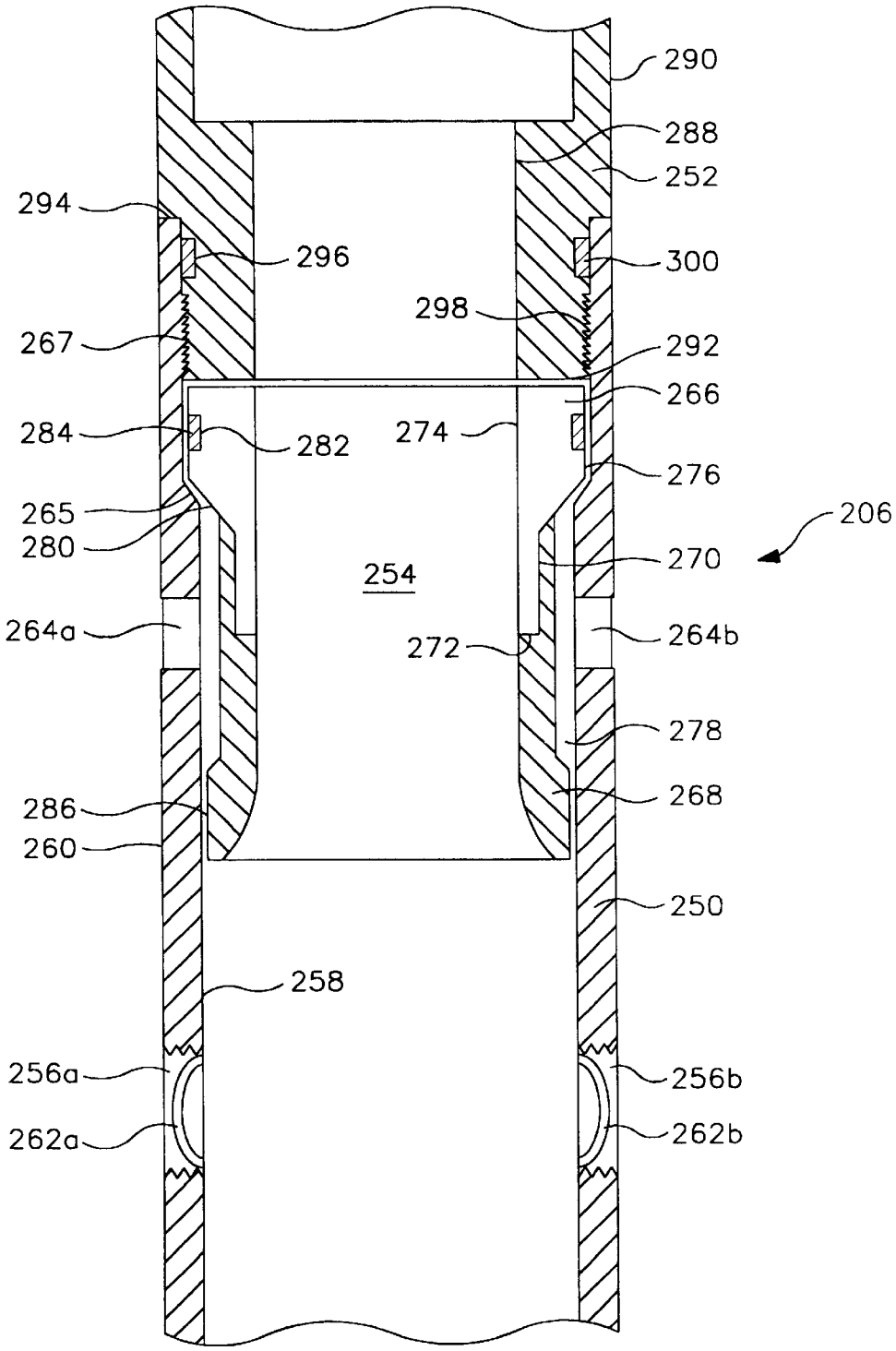
FIG. 6 is an enlarged, schematic, cross-sectional view of a pressurization assembly of the completion apparatus of FIG. 3.

Referring now to FIGS. 3 and 6, an enlarged, schematic, cross-sectional view of pressurization assembly 206 is illustrated. Pressurization assembly 206 preferably comprises an a lower sub 250, an upper sub 252 removably coupled to lower sub 250, and a sealing sub 254 disposed within lower sub 250.

Lower sub 250 preferably includes internally threaded ports 256*a* and 256*b* that provide a fluid communicating path between an axial bore 258 of lower sub 250 and an annulus 146 (FIG. 3) defined by an external surface 260 of pressurization assembly 206, an internal surface of liner 122, lower packing assembly 202, and upper packing assembly 204. Conventional rupture disks 262*a* and 262*b* are preferably removably contained in ports 256*a* and 256*b*, respectively. When contained in ports 256*a* and 256*b*, rupture disks 262*a* and 262*b* create a fluid tight seal between the interior of pressurization assembly 206 and annulus 146. A preferred rupture disk for rupture disks 262*a* and 262*b* is the disk sold by Oklahoma Safety Equipment Company (OSECO) of Broken Arrow, Okla.

Although not shown in FIG. 6, other conventional fluid bypass devices other than a rupture disk, such as a ball drop circulating valve, an internal pressure operated circulating valve, or other conventional circulating valve may be operatively coupled with ports 256*a* and 256*b*. A preferred internal pressure operated circulating valve is the IPO Circulating Valve sold by Halliburton Energy Services of Carrollton, Tex. All of these fluid bypass devices, including rupture disks 262*a* and 262*b*, have a first mode of operation that does not allow fluid to flow through ports 256*a* and 256*b* into annulus 146, and a second mode of operation that allows fluid to flow through ports 256*a* and 256*b* into annulus 146.

Lower sub 250 also preferably includes ports 264*a* and 264*b*. Each of ports 264*a* and 264*b* provide a fluid communicating path between the interior of pressurization assembly 206 and annulus 146. Axial bore 258 preferably has an annular shoulder 265 and threads 267 disposed above ports 264*a* and 264*b*.

Sealing sub 254 preferably includes an annular supporting member 266 and an annular, elastomeric sleeve 268 coupled to a lower end of supporting member 266. Sleeve 268 is preferably adhesively coupled to supporting member 266 along a portion 270 and shoulder 272 of support member 266. When coupled together, supporting member 266 and sleeve 268 define an axial bore 274 and an external surface 276. External surface 276 has an annular recess 278 proximate ports 264*a* and 264*b*; a shoulder 280 for mating with shoulder 265 of lower sub 250, and an annular slot 282 above annular recess 278. An o-ring 284 is disposed in slot 282 and creates a fluid tight seal between sealing sub 254 and lower sub 250. In its undeflected position, as shown in FIG. 6, a lower end 286 of sleeve 268 creates a fluid tight seal against axial bore 258 of lower sub 250.

Upper sub 252 preferably includes an axial bore 288, an external surface 290, and a lower end 292. External surface 290 preferably includes an annular shoulder 294 for mating with lower sub 250, an annular slot 296, and threads 298 for removably engaging threads 267 of lower sub 250. An o-ring 300 is disposed within annular slot 296 to create a fluid tight seal between lower sub 250 and upper sub 252. Lower end 292 abuts support member 266 of sealing sub 254.

Having described the structure of completion apparatus 200, the operation of completion apparatus 200 so as to complete junction 100 will now be described in greater detail. Referring to FIGS. 1–6 in combination, after wiper plug 133 is landed at, and seals off, stage cementing tool 138, work string 128 is pulled above top portion 134 of liner 122. Excess sealant within work string 128 and above top portion 134 of liner 122 is then circulated out of the well.

Next, work string 128 is run into liner 122 until no-go sleeve 207 of lower packing assembly 202 contacts no-go shoulder 142 of liner 122. At this point, a fluid tight seal is created between seal assembly 205 of lower packing assembly 202 and polished bore receptacle 144 of liner 122. Alternatively, if packer 220 is utilized as lower packing assembly 202, packer 220 is set to create a fluid tight seal against liner 122. Also at this point, a fluid tight seal is created between upper packing assembly 204 and liner 122 in a manner substantially similar to that described immediately above for lower packing assembly 202. No-go shoulder 142 of liner 122 is positioned within lateral wellbore 104 so that lower packing assembly 202 is located below window 120, and so that upper packing assembly 204 is located above window 120, within junction 100.

When lower packing assembly 202 and upper packing assembly 204 use seal assemblies 205, the pressure on the drilling mud, water, or other fluid already within annulus 146 will increase as lower packing assembly 202 and upper packing assembly 204 seal against liner 122. Before no-go sleeve 207 engages no-go shoulder 142, such an increase in pressure, applied across the differential areas of lower packing assembly 202 and upper packing assembly 204, may cause a hydraulic lock effect preventing further insertion of work string 128 into liner 122. In addition, when lower packing assembly 202 and upper packing assembly 204 use conventional packers 220, a similar hydraulic lock effect may create problems for conventional packers 220 that employ a downward setting motion.

However, such an increase in pressure is relieved by sealing sub 254 of pressurization assembly 206 in the following manner. Due to the increase in pressure, fluid enters ports 264*a* and 264*b* to the point where it fills annular recess 278. The pressure in annular recess 278 builds to the point where lower end 286 of elastomeric sleeve 268 temporarily deflects inwardly, unsealing from axial bore 258 of lower sub 250. Such unsealing allows fluid to flow from annular recess 278 into the interior of pressurization assembly 206, reducing the pressure in annulus 146 and eliminating the above-described hydraulic lock problems.

Next, a fluid tight seal is created proximate the end of work string 128 below lower packing assembly 202. Such a fluid tight seal is preferably formed using a wire-line plug, by pumping a plug down work string 128, or other conventional techniques. A preferred plug is the X-Lock™ Plug sold by Halliburton Energy Services of Carrollton, Tex.

Next, a fluid such as water or drilling mud is pumped down work string 128. Due to the fluid tight seal created by the plug at the end work string 128, the pressure within pressurization assembly 206 is increased to the point where rupture disks 262*a* and 262*b* rupture. The rupturing of rupture disks 262*a* and 262*b* places the interior of pressurization assembly 206 in fluid communication with annulus 146 via ports 256*a* and 256*b*. Alternatively, if a fluid bypass device other than rupture disks are utilized, such pressurization causes the fluid bypass device to enter its second mode of operation that allows fluid to flow through ports 256*a* and 256*b* to annulus 146.

Next, the pressure within work string 128, and thus annulus 146, is preferably continuously and gradually increased so as to plastically deform the portion of liner 122 between lower packing assembly 202 and upper packing assembly 204 radially outward toward window 120, main wellbore casing 106, and lateral wellbore 104. It will be appreciated that if a cementitious sealant or conventional cement is used for sealant 124 proximate junction 100, such deformation of liner 122 must occur before the cementitious sealant or cement hardens. However, if an elastomeric sealant is used for sealant 124 proximate junction 100, such deformation may occur before, or after, the elastomeric sealant hardens due to the ductility of the sealant.

Such deformation of liner 122 provides significant advantages in the completion of junction 100. First, as liner 122 is deformed radially outward, sealant 124 in the portion of the annulus between liner 122, main wellbore casing 106, and lateral wellbore 104 within junction 100 is placed in compression. Such compression provides a higher pressure rating for junction 100 during subsequent completion or production operations in the multilateral well.

Second, because window 120 is defined by the intersection of cylindrical main wellbore casing 106 and generally cylindrical lateral wellbore 104, window 120 has a generally elliptical shape, with a major axis generally parallel to the longitudinal axis of main wellbore casing 106. Therefore, the outward deformation of liner 122 works to close the joints or gaps between liner 122 and window 120 present at the top and bottom of window 120. Such joint closure in turn minimizes leak paths, and thus leaks, within junction 100. In situations where the outward deformation of liner 122 may result in metal to metal contact of liner 122 and window 120, it is preferable to use a reinforced liner 122 to insure that any jagged or sharp edges on window 120 do not pierce liner 122.

Third, the outward deformation of liner 122 increases the inner diameter of liner 122. This increase in inner diameter results in a larger flow path for petroleum from lateral wellbore 104, increasing the productivity of the well. This increase in inner diameter also results in a larger clearance for downhole tools to enter and exit lateral wellbore 104 during subsequent completion or production operations.

It will be appreciated that after liner 122 has been deformed radially outward via hydraulic pressure as described hereinabove, a second work string with a sizing mandrel may optionally be run down main wellbore casing 106 and through junction 100 to insure adequate deformation of liner 122.

Figure 7:
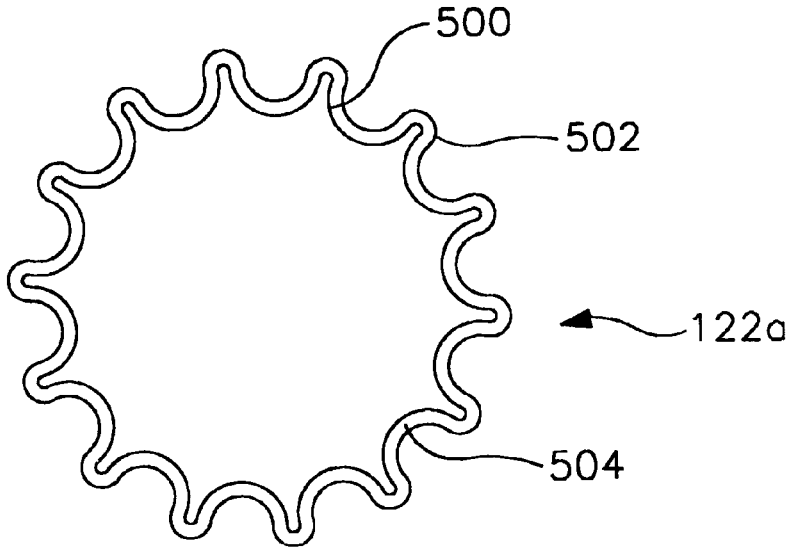
FIG. 7 is an enlarged, schematic, top sectional view of an alternate embodiment of a lateral liner used in connection with the present invention.

Referring now to FIG. 7, an enlarged, schematic, top sectional view of an alternate lateral liner 122*a* that may be used in connection with completion apparatus 200 is illustrated. Lateral liner 122*a* is formed with a grooved internal surface 500 and a grooved external surface 502. Liner 122*a* thus preferably has a cross-section 504 resembling a bellows. The geometry of grooved surfaces 500 and 502 facilitate the outward deformation of liner 122*a* at lower pressures. A lower pressure requirement for the outward deformation of liner 122*a* in turn reduces the risk of failure of the seals created by lower packing assembly 202 and upper packing assembly 204. In addition, as compared to a liner with a generally cylindrical cross-section, liner 122*a* provides a larger, expanded outer diameter from a smaller, undeformed, run in outer diameter. As shown in FIG. 7, grooved surfaces 500 and 502 preferably comprise grooves having a "sinusoidal" cross-section. However, grooved surfaces 500 and 502 may alternatively comprise grooves having a "saw tooth", "square tooth", or other cross-sectional geometry. In addition, preferably only the portion of liner 122*a* between lower packing assembly 202 and upper packing assembly 204 is formed with grooved external surface 502, and the remainder of liner 122*a* is formed with a generally cylindrical external surface.

Figure 8:
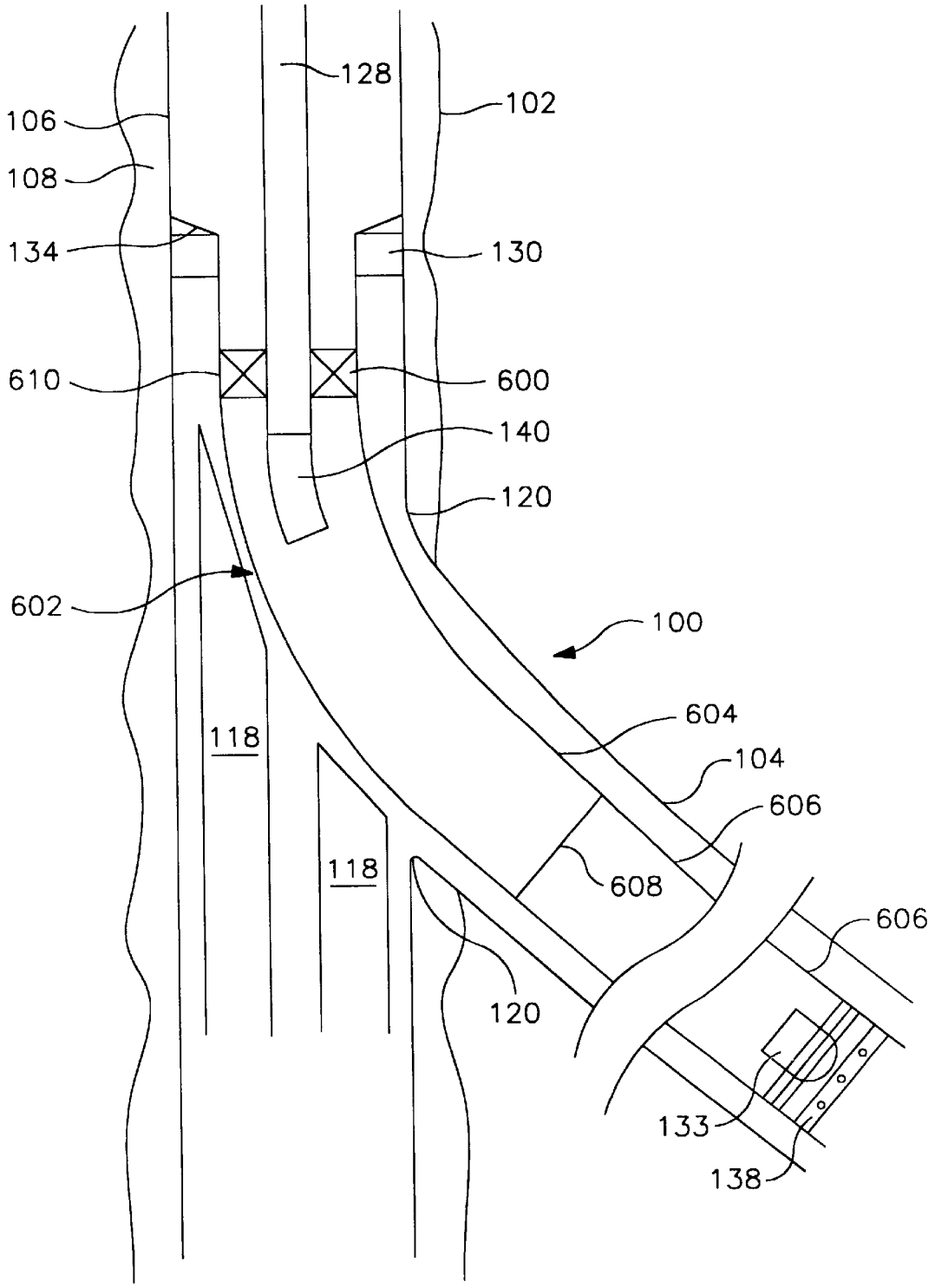
FIG. 8 is an enlarged, schematic, cross-sectional, fragmentary view of the junction of FIG. 1 showing a schematic view of packing assembly and a liner for completing the junction according to a second, preferred embodiment of the present invention.

Referring now to FIG. 8, an enlarged, schematic, cross-sectional, view of a packing assembly 600 and a liner 602 according to a second, preferred embodiment of the present invention are shown disposed within junction 100. Packing assembly 600 is preferably coupled to work string 128 above supporting mandrel 140, and packing assembly 600 preferably has a substantially identical structure to upper packing assembly 204 of completion apparatus 200. Liner 602 is preferably comprised of an upper section 604, a lower section 606, and a tool joint or other conventional coupling mechanism 608 coupling upper section 604 and lower section 606. Alternatively, liner 602 can be machined to have upper section 604 and lower section 606, without the need for a coupling mechanism 608.

If seal assembly 205 is utilized for packing assembly 600, liner 602 preferably includes a polished bore receptacle 610 located on the inner diameter of liner 602 below liner hanger 130. If packer 220 is used for packing assembly 600, polished bore receptacle 610 may be eliminated, if desired.

Figure 9A:
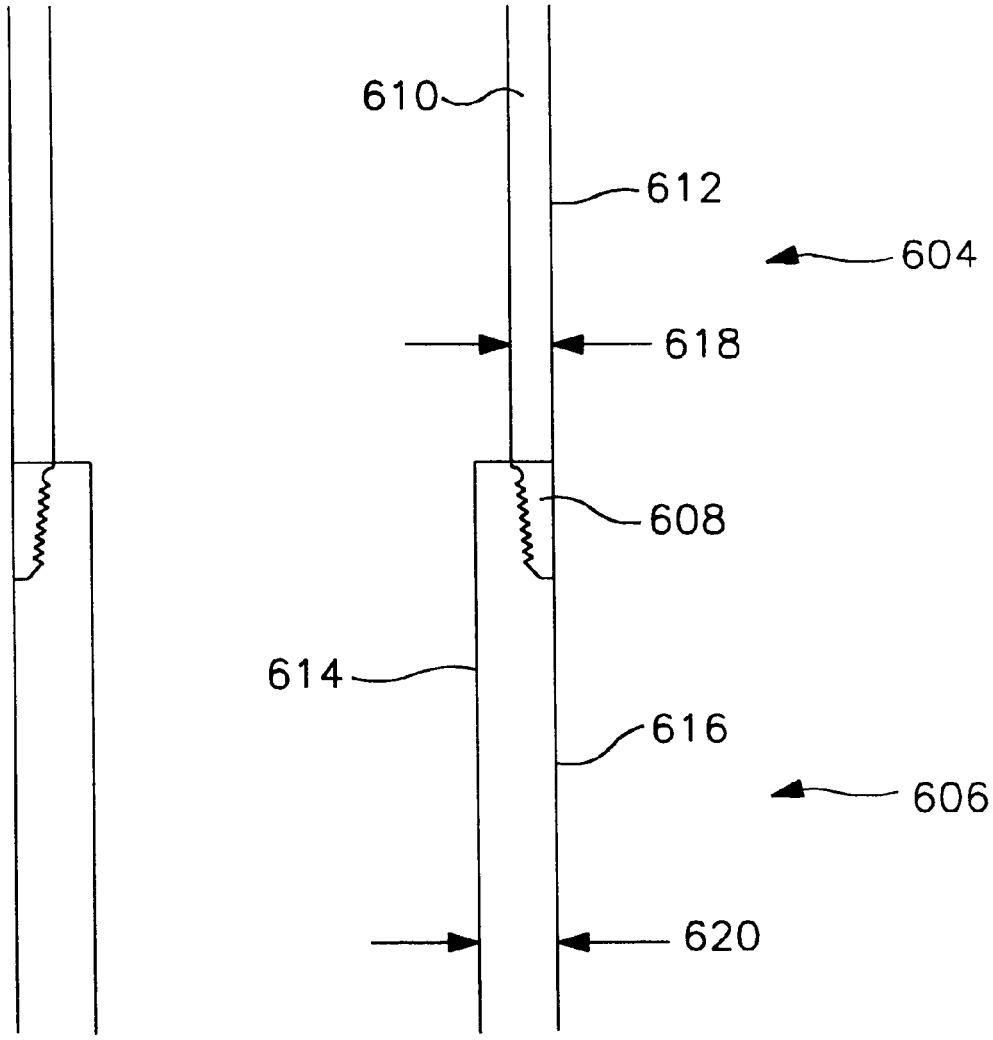
FIG. 9A is an enlarged, schematic, cross-sectional, fragmentary view of one embodiment of the liner of FIG. 8.

As shown in FIG. 9A, upper section 604 and lower section 606 are made from the same material or casing grade. By way of illustration only, both upper section 604 and lower section 606 may be made of casing grade API N-80, which has a yield strength of approximately 80,000 psi. Upper section 604 preferably has a generally cylindrical axial bore 610 and a generally cylindrical external surface 612. Lower section 606 preferably has a generally cylindrical axial bore 614 a generally cylindrical external surface 616. However, upper section 604 has a wall thickness 618 smaller than a wall thickness 620 of lower section 606.

Figure 9B:
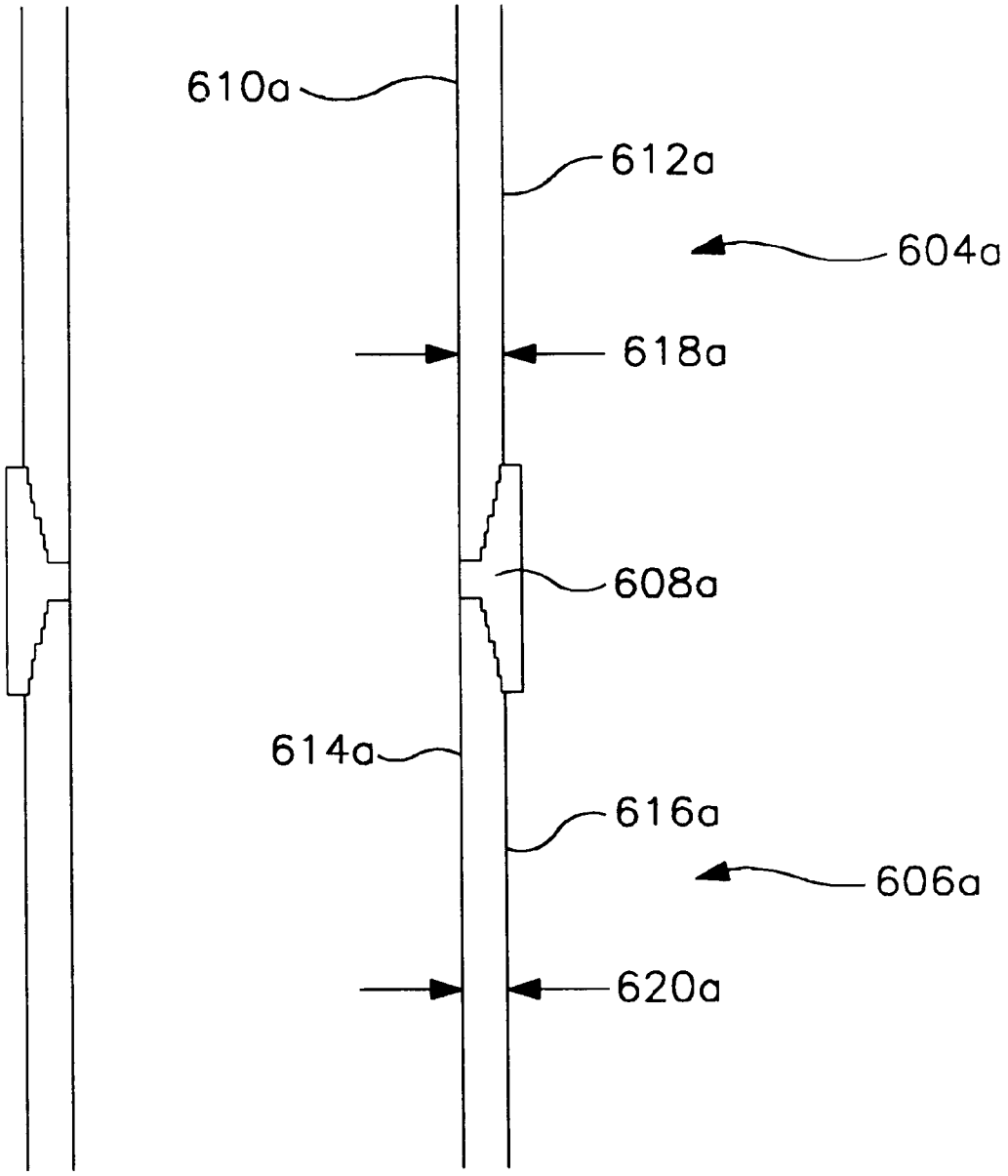
FIG. 9B is an enlarged, schematic, cross-sectional, fragmentary view of a second embodiment of the liner of FIG. 8.

As shown in FIG. 9B, upper section 604*a* preferably has a generally cylindrical axial bore 610*a* and a generally cylindrical external surface 612*a*. Lower section 606*a* has a generally cylindrical axial bore 614*a* a generally cylindrical external surface 616*a*. Upper section 604*a* has a wall thickness 618*a* substantially identical to a wall thickness 620*a* of lower section 606*a*. However, upper section 604*a* and lower section 606*a* are made from different materials or casing grades. More specifically, upper section 604*a* is made from a material or casing grade having a lower yield strength than the material or casing grade of lower section 606*a*. By way of illustration only, upper section 604*a* may be made from casing grade API K 55, which has a yield strength of approximately 55,000 psi, and lower section 606*a* may be made of casing grade API N-80, which has a yield strength of approximately 80,000 psi.

In FIG. 9A, upper section 604 may also be made from a casing grade having a lower yield strength that the casing grade used to make lower section 606. Although not shown in FIG. 9B, upper section 604*a* may also be formed with a smaller wall thickness 618*a* than wall thickness 620*a* of lower section 606*a*.

It is believed that by varying the wall thickness and/or casing grade of upper section 604 relative to the wall thickness and/or casing grade of lower section 606, as described hereinabove, the design of liner 602 may be optimized so that for a given internal pressure, upper section 604 plastically deforms in a radially outward direction, and lower section 606 does not exhibit substantial radial deformation.

Having described the structure of packing assembly 600 and liner 602, the operation of these apparatus so as to complete junction 100 will now be described in greater detail. Referring to FIGS. 1, 2, 4, 5, 8, 9A, and 9B in combination, after wiper plug 133 is landed at, and seals off, stage cementing tool 138, work string 128 is pulled above top portion 134 of liner 602. Excess sealant within work string 128 and above top portion 134 of liner 602 is then circulated out of the well.

Next, work string 128 is run into liner 602 until seal assembly 205 of packing assembly 600 creates a fluid tight seal against polished bore receptacle 610 of liner 602. An increase in pressure may be observed top hole by conventional pressure measuring devices when seal assembly 205 is properly seated against polished bore receptacle 610. Alternatively, if packer 220 is utilized as packing assembly 600, packer 220 is set to create a fluid tight seal against liner 602 below liner hanger 130.

Next, a fluid such as water or drilling mud is pumped down work string 128. Due to the fluid tight seal created by packing assembly 600 against liner 602, fluid eventually fills all of liner 602 below packing assembly 600 down to wiper plug 133 sealed in stage cementing tool 138. The pressure within work string 128, and thus liner 602, is preferably continuously and gradually increased so as to plastically deform upper section 604 radially outward toward window 120, the portion of main wellbore casing 106 proximate window 120, and the portion of lateral wellbore 104 proximate window 120. As the deformation of upper section 604 occurs, lower section 606 preferably does not exhibit substantial radial deformation.

Such deformation of upper section 604 provides substantially the same, significant advantages in the completion of junction 100 as described hereinabove for completion apparatus 200. In addition, upper section 604 may be formed with an external surface 612 similar to grooved external surface 502 of FIG. 7, if desired.

Figure 10:
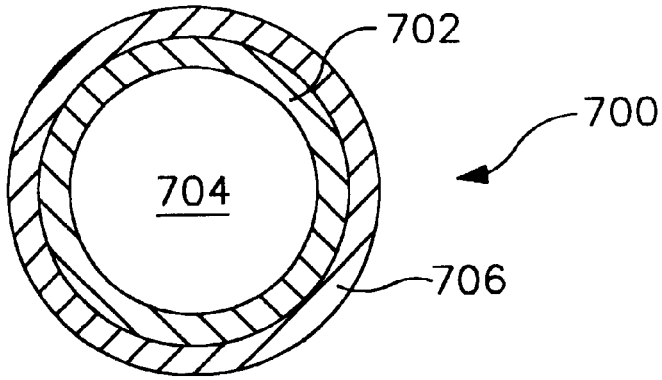
FIG. 10 is an enlarged, schematic, top sectional view of a second alternate embodiment of a lateral liner used in connection with the present invention.

Referring now to FIG. 10, an enlarged, schematic, top sectional view of an alternate lateral liner 700 that may be used in connection with completion apparatus 200, or in the upper section 604 of liner 602, is illustrated. Liner 700 has an interior cross-section 702 made from steel, steel alloys, plastic, or other generally non-elastomeric materials conventionally used for lateral liners. Interior cross-section 702 has an axial bore 704. Liner 700 further has an exterior cross-section 706 made from rubber or another conventional elastomeric material. When liner 700 is surrounded by sealant 124 and plastically deformed as described hereinabove, exterior cross-section 706 insures an adequate seal of junction 100. Alternatively, liner 700 may be plastically deformed as described hereinabove but without the use of sealant 124 in certain completions. In such completions, exterior cross-section 706 itself seals against window 120, main wellbore casing 106, and lateral wellbore 104.

From the above, one skilled in the art will appreciate that the present invention provides improved apparatus and methods for completing wellbores. The present invention provides such improved completion without inhibiting the amount or rate of well production, or substantially increasing the cost or complexity of the completion of the wellbore. Significantly, the present invention allows the operations of running a lateral liner, sealing a lateral liner, and plastically deforming a lateral liner to be accomplished in a single downhole trip. The apparatus and methods of the present invention are economical to manufacture and use in a variety of downhole applications.

The present invention is illustrated herein by example, and various modifications may be made by a person of ordinary skill in the art. For example, numerous geometries and/or relative dimensions could be altered to accommodate specific applications of the present invention. As another example, although the present invention has been described in connection with the completion of a junction between a main wellbore and a lateral wellbore in a multilateral well, it is fully applicable to the completion of a junction between a lateral wellbore and a second lateral wellbore extending from the lateral wellbore, to completion operations performed in other portions of a lateral wellbore other than such a junction, to completion operations performed in other portions of a main wellbore, to casing repair operations, or to window closures.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

What is claimed is:

1. A method of completing a well, comprising the steps of:

providing a liner having a first section and a second section, the first section being deformable in a radially outward direction at a lower pressure than the second section;

disposing the liner in the well;

coupling a packing assembly to a work string;

running the work string into the liner;

creating a fluid tight seal between the packing assembly and the liner;

pumping fluid down the work string to pressurize an interior of the liner after the packing assembly has been set; and increasing a pressure in the interior of the liner so as to deform the first section of the liner in a radially outward direction while the liner extends within first and second intersecting wellbores of the well.

2. The method of claim 1 wherein the first section and the second section are made from an identical casing grade, and the first section has a smaller wall thickness than the second section.

3. The method of claim 1 wherein the first section and the second section have an identical wall thickness, the first section is made from a first casing grade, and the second section is made from a second casing grade having a yield strength higher than the first casing grade.

4. The method of claim 1 wherein:

the first section is made from a first casing grade and has a first wall thickness; and the second section is made from a second casing grade having a higher yield strength than the first casing grade, and the second section has a second wall thickness greater than the first wall thickness.

5. The method of claim 1 wherein the packing assembly comprises a seal assembly that mates with a polished bore receptacle located in the liner.

6. The method of claim 1 wherein the packing assembly comprises a packer.

7. The method of claim 1 wherein at least a portion of the first section of the liner has grooved internal and external surfaces.

8. The method of claim 1, wherein the step of disposing the liner comprises:

coupling the liner to an end of the work string; and running the work string into the well.

9. The method of claim 8, further comprising the step of disposing a sealant in an annulus defined by the liner and the well.

10. The method of claim 9 wherein the step of disposing sealant comprises pumping sealant through the work string, the packing assembly, and the liner, and into the annulus.

11. The method of claim 1 wherein the first section has an interior cross-section made from a generally non-elastomeric material, and an exterior cross-section made from a generally elastomeric material.

12. The method of claim 1 wherein the disposing step comprises disposing the liner in a junction between the first and second wellbores so that the first section extends throughout the junction.

13. The method of claim 12 wherein the running step comprises running the work string into the liner until the packing assembly is disposed before the junction.

14. A method of completing a well having first and second wellbores, the second wellbore intersecting and extending outwardly from the first wellbore, the method comprising the steps of:

positioning a tubular structure at the intersection of the first and second wellbores;

disposing a sealant at the intersection external to the tubular structure after the tubular structure is positioned at the intersection; and extending the tublar structure radially outwardly at the intersection thereby compressing the sealant.

15. The method according to claim 14, wherein the extending step further comprises extending the tubular structure toward a window formed in a sidewall of the first wellbore.

16. The method according to claim 15, wherein the extending step further comprises contacting the window with the tubular structure.

17. The method according to claim 16, wherein the contacting step further comprises sealingly engaging the window with the tubular structure.

18. The method according to claim 16, wherein the contacting step further comprises engaging an outer seal surface of the tubular structure with the window.

19. The method according to claim 16, wherein the contacting step further comprises forming the tubular structure to a complementary shape relative to the window.

20. The method according to claim 14, wherein the extending step is performed by applying fluid pressure to an interior of the tubular structure.

21. The method according to claim 20, wherein the fluid pressure applying step is performed by isolating a portion of the tubular structure, and applying the fluid pressure to the isolated portion.

22. The method according to claim 20, wherein the fluid pressure applying step is performed by providing the tubular structure with a reduced wall thickness portion, and applying the fluid pressure to the reduced wall thickness portion.

23. The method according to claim 20, wherein the fluid pressure applying step is performed by providing the tubular structure with a reduced yield strength portion, and applying the fluid pressure to the reduced yield strength portion.

24. The method according to claim 20, wherein the fluid pressure applying step is performed by providing the tubular structure with a corrugated portion, and applying the fluid pressure to the corrugated portion.

25. The method according to claim 14, further comprising the step of permitting the sealant to harden, and wherein the extending step is performed prior to hardening of the sealant.

26. The method according to claim 14, further comprising the step of permitting the sealant to set to a generally elastomeric state, and wherein the extending step is performed after the sealant has set.

27. A method of completing a well having first and second wellbores, the second wellbore intersecting and extending outwardly from the first wellbore, the method comprising the steps of:

positioning a tubular structure at the intersection of the first and second wellbores;

inserting a completion apparatus within the tubular structure, the completion apparatus including a device configured for internally pressurizing the tubular structure, and at least one seal for sealing engagement with the tubular structure; and pressurizing at least a portion of the tubular structure internally, thereby radially outwardly extending the tubular structure.

28. The method according to claim 27, wherein in the inserting step, the completion apparatus includes first and second seals sealingly engaging the tubular structure at opposite ends of the tubular structure portion.

29. The method according to claim 27, wherein in the inserting step, the tubular structure portion is at least partially corrugated.

30. The method according to claim 27, wherein in the inserting step, the tubular structure portion has a reduced wall thickness.

31. The method according to claim 27, wherein in the inserting step, the tubular structure portion has a reduced yield strength.

* * * * *